US006578400B1

(12) United States Patent
Bonny et al.

(10) Patent No.: US 6,578,400 B1
(45) Date of Patent: Jun. 17, 2003

(54) INTERNAL HIGH PRESSURE FORMING METHOD FOR A WORKPIECE

(75) Inventors: Pierre Bonny, Hamburg (DE); Matthias Schroeder, Gruenendeich (DE); Stefan Schwarz, Buxtehude (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/763,973

(22) PCT Filed: Jul. 10, 1999

(86) PCT No.: PCT/EP99/04888

§ 371 (c)(1),
(2), (4) Date: Jun. 7, 2001

(87) PCT Pub. No.: WO00/12240

PCT Pub. Date: Mar. 9, 2000

(30) Foreign Application Priority Data

Aug. 28, 1998 (DE) ..... 198 39 353

(51) Int. Cl.[7] ..... B21D 39/20
(52) U.S. Cl. ..... 72/58; 72/62; 72/710
(58) Field of Search ..... 72/56, 58, 61, 72/62, 710

(56) References Cited

U.S. PATENT DOCUMENTS 3,800,578 A * 4/1974 Brennan et al. ..... 72/56
3,879,974 A 4/1975 Biddell et al. ..... 72/56
5,485,739 A * 1/1996 Grimmett ..... 72/446
5,505,068 A * 4/1996 Bartels ..... 72/62
6,029,487 A * 2/2000 Genin et al. ..... 72/58

FOREIGN PATENT DOCUMENTS

| | | |
|---|---|---|
| CH | 334 023 | 12/1958 |
| DE | 38 40 939 | 6/1990 |
| DE | 197 51 035 | 5/1999 |
| GB | 2 240 944 | 8/1991 |

* cited by examiner

*Primary Examiner*—David Jones
(74) *Attorney, Agent, or Firm*—Crowell & Moring LLP

(57) ABSTRACT

A method and an apparatus are provided for internal high-pressure forming of a workpiece in a closed internal high-pressure forming die. The workpiece is expanded owing to the internal high fluid pressure exerted by a pressure generator and coming to rest on the cavity of the forming die. The workpiece and the forming die form friction partners in the areas of contact. In order to improve process reliability during the internal high-pressure forming of workpieces and to expand the scope of the method, vibration is imparted directly to at least one of the friction partners by a vibration generator during forming.

22 Claims, 2 Drawing Sheets

INTERNAL HIGH PRESSURE FORMING METHOD FOR A WORKPIECE

Figure 1:
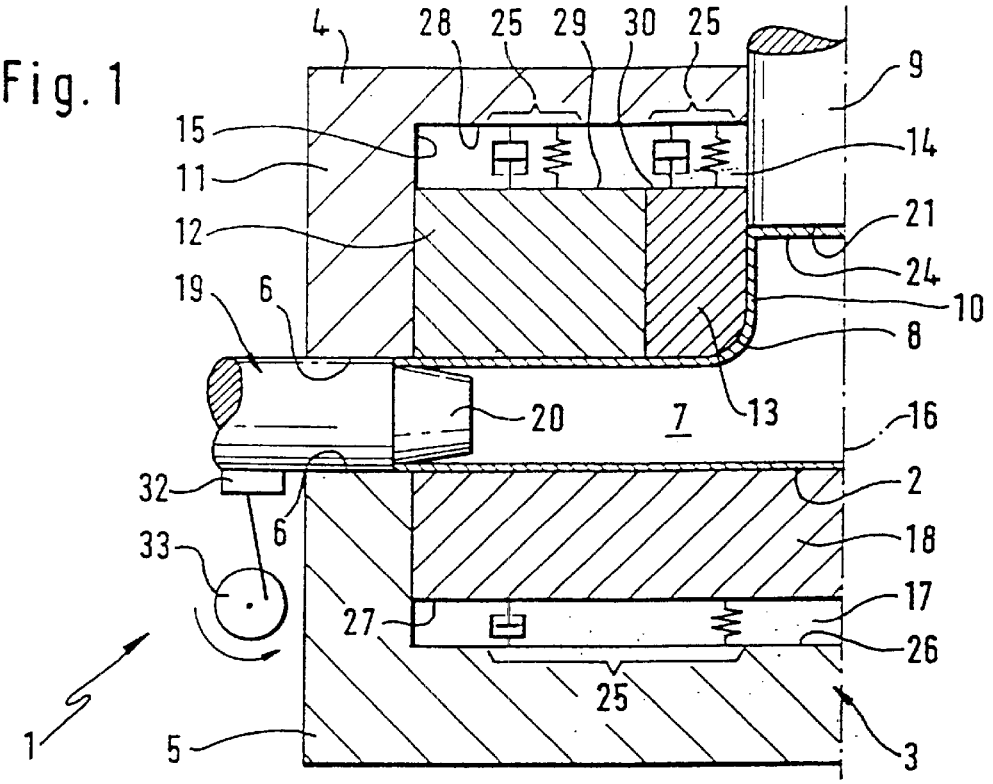

The invention relates to a method for internal high-pressure forming of a workpiece and to an apparatus for carrying out the method.

A method of the generic type and an apparatus of the generic type are known from DE 94 07 812.2 U1. Here, a hollow section forming the workpiece is inserted into an internal high-pressure forming die split in the direction of extension of the hollow section, after which the die is closed. The hollow section is then closed in a sealing manner at both ends by axial rams. The interior of the hollow section is filled via the axial rams. The axial rams have a fluid connection to a pressure generator. An internal high pressure within the hollow section is then applied by means of the pressure generator, thereby expanding the section until it comes to rest against the wall of the die cavity. The die cavity has a branch that leads radially away from the direction of extension of the hollow section and into which the material of the hollow section can be displaced by the imposition of the internal high pressure to form a neck. Here too, the material comes to rest against the wall of the branch. The process of expansion within the branch is stabilized by means of a sliding counter plug, which is guided displaceably in the branch and supports the neck at the end. To raise the failure limits as regards bursting during pure expansion, during which the length of the hollow section decreases, and thus obtain a longer length of expansion in the neck, an additional axial force, which is applied by moving the axial rams inwards, is used to feed additional material from the hollow section to the branching point, thereby at least partially compensating for the thinning of the material in the region of the branch that is responsible for bursting. Nevertheless, the friction that arises between the die and the hollow section when the material of the hollow section comes to rest against the wall of the cavity, specially in the branch, which increases as the internal high pressure increases—even when the outside of the hollow section is provided with a lubricant—considerably restricts the formability of the material. This is very problematic, especially in the case of materials with poor formability.

The object on which the invention is based is to develop a method of the generic type and an apparatus of the generic type in such a way that process reliability during the internal high-pressure forming of workpieces is improved.

According to the invention, the object is achieved as regards the method by the features of Patent claim 1 and as regards the apparatus by the features of Patent claim 11. Owing to the excitation of vibration in one of the friction partners (workpiece, forming die), the friction of the workpiece on the wall of the cavity is reduced in between the maxima of the vibration since there the contact force of the workpiece on the forming die is lowered. This means that there is periodic partial relief of the normal contact stress between the workpiece and the die during the forming operation. In drastic cases, this can be such that locally the workpiece loses contact completely with the die for a brief period. However, the associated reduction in friction also means that resistance to the inflow or infeed of additional workpiece material towards the forming location also decreases, allowing more material to be moved to this location without failure occurring. Thinning of material in the forming zone is thus counteracted, it being possible to achieve a distribution of material that is more favourable for forming, in particular more uniform wall thickness distribution and/or to increase the degree of forming. In the case of a branch from the cavity for example, i.e. the formation of a neck, this can mean an increase in the length of extension. The limits of the method can thus be extended, e.g. as regards the production of secondary formed elements. Owing to the increased supply of additional material, it is furthermore also possible to form smaller radii on the workpiece in a reliable process without the occurrence of cracking. Overall, improved forming, even of workpieces made of materials with a low deformability, is achieved by means of the invention. By partial decoupling of the process parameters from the tribological conditions, higher process stability is achieved. For optimum design of the method to give the maximum utility for the respective forming task, the amplitude and frequency of the vibration should be adapted to take account of the material of the workpiece and degree of forming involved in the shape to be obtained, i.e. the geometry of the fully formed workpiece or other relevant process parameters. Moreover, the structural vibration of the friction partners leads to more uniform distribution of lubricants when using lubricants on the surface of the workpiece, leading to a further reduction in friction. Owing to the vibratory relative motion of the friction partners and the activation of the lubricant introduced, adhesive contact is to the greatest possible extent avoided while sliding friction is simultaneously reduced, and the transition from static to sliding friction (stick-slip effect) is considerably reduced. This makes it possible to select a lubricant for less demanding requirements and/or to apply less lubricant or even to dispense with lubricant while ensuring improved forming.

Figure 2:
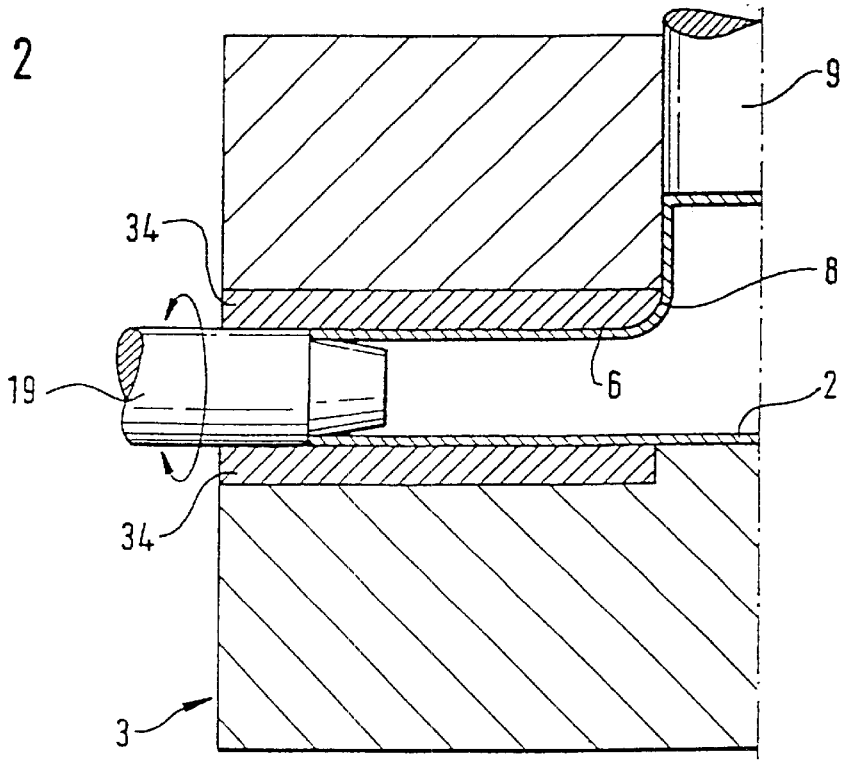
Figure 3:
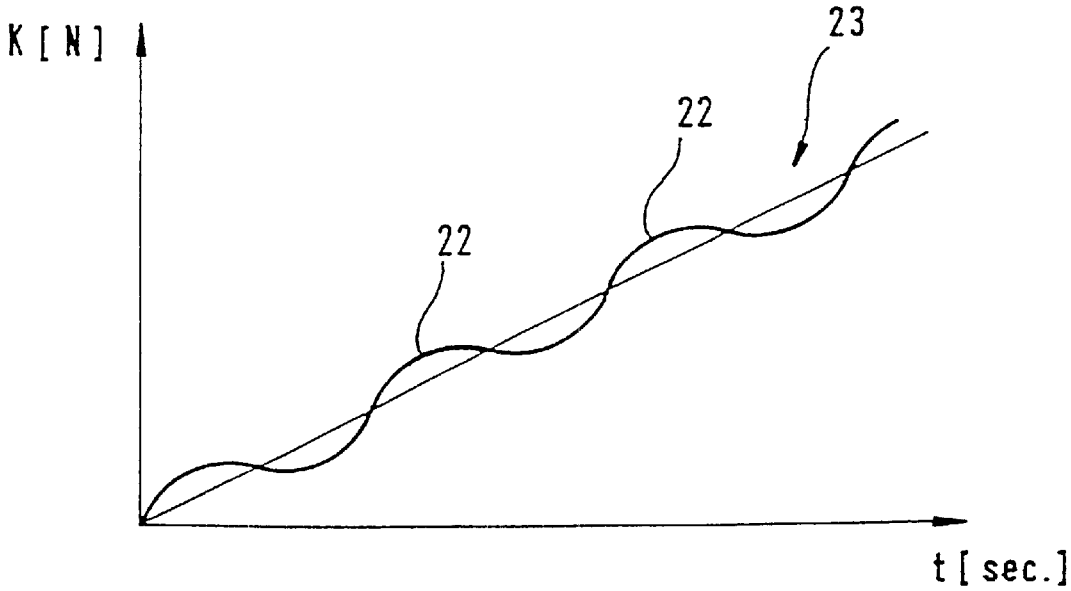
Figure 4:
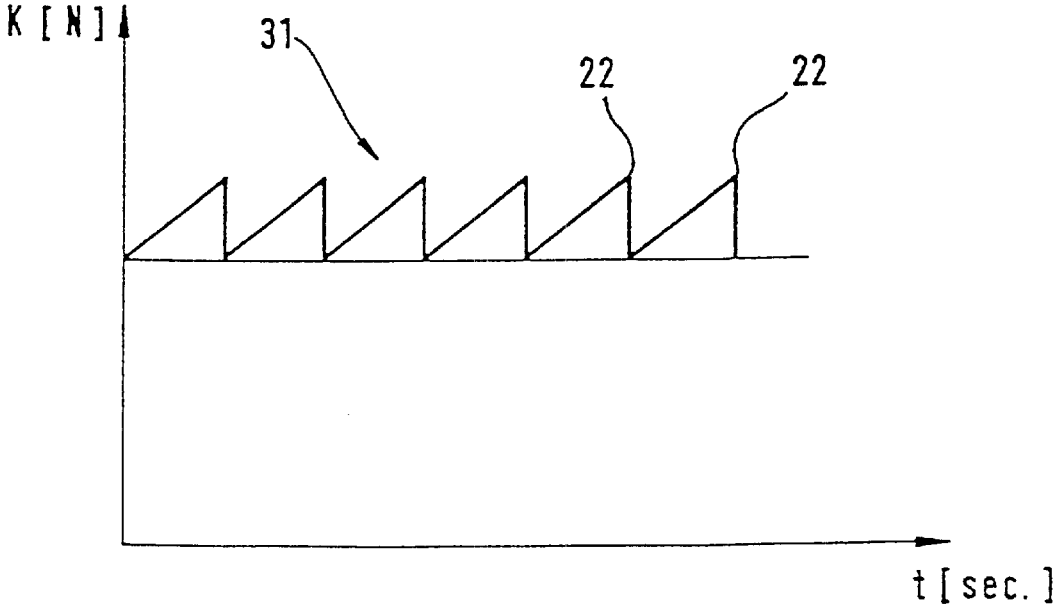

Expedient refinements of the invention can be found in the subclaims; the invention is furthermore explained in greater detail below with reference to two exemplary embodiments illustrated in the drawings, in which:

FIG. 1 shows an apparatus according to the invention in a longitudinal section from the side, the said apparatus comprising a plurality of forming-die components with vibration generators, FIG. 2 shows an apparatus according to the invention in a longitudinal section from the side, with a vibration generator coupled to the workpiece, FIG. 3 shows a force/time diagram for the vibration-generating control of one of the friction partners with a force characteristic that rises on average, FIG. 4 shows a force/time diagram for the vibration-generating control of one of the friction partners with a force characteristic that remains constant on average.

FIG. 1 shows an apparatus 1 for the expansion by internal high-pressure forming of a workpiece 2 that is formed by a hollow section in this exemplary embodiment but can also comprise two blanks placed one on top of the other for the purpose of expanding the blanks. The apparatus 1 comprises an internal high-pressure forming die 3, which is divided into a top die 4 and a bottom die 5, the cavities 6 of which form the forming space 7 for the hollow section 2 to be expanded. The top die 4 has a branch 8 that diverges radially from the main direction of the forming space 7 and in which a counter ram 9 of the apparatus 1 is displaceably guided, the said ram counteracting the internal high pressure within the hollow section 2. The counter ram 9, which is guided in a manner that allows it to be monitored and controlled, is used to stabilize the flow of material of the workpiece during the formation of a neck 10 matching the contours of the branch 8 and thus serves to ensure reliability of the process involved in the forming that takes place at this point of the hollow section 2, the counter ram 9 moving backwards as the length of the neck increases.

The top die 4 furthermore has a plurality of die components 11, 12 and 13, die component 11 forming a housing with an upper accommodation space 14, which is open towards the hollow section 2 and in which the two other die components 12 and 13, which include the most important portion of the cavity 6 for expansive forming, are held in a manner that allows them to be moved relative to the hollow section 2. In FIG. 1, it can be seen that die components 12 and 13 can be moved radially relative to the rectilinear portion of the hollow section 2. However, it would also be conceivable only for die component 13, which delimits the region of the branch 8, to be capable of movement in a direction radial to the neck 10 that forms when internal high pressure is imposed. In this arrangement, die component 13 is supported displaceably on a side wall 15 of the accommodation space 14. It is furthermore conceivable for die components 12 and 13 to be connected integrally to one another and to be displaceable both radially relative to the rectilinear part of the hollow section 2 inserted into the forming die 3 and axially to it and hence radially to the neck 10 of the hollow section 2. Although only one side of the apparatus 1 is shown in the drawing, it should be imagined as mirror-symmetrical about the centre line 16 in its complete form.

The bottom die 5 has a lower accommodation space 17, which is open towards the top and in which a die component 18 of the bottom die 5, which essentially contains the lower cavity, is guided in a manner which allows it to execute a stroke motion. The hollow section 2 is furthermore sealed off at both ends by a sealing ram 19, which either remains rigidly in its initially adopted position of use during the forming process, ensuring a sealed metallic clamped joint between the hollow section 2 and the sealing taper 20 of the sealing ram 19, or can be made to execute a follow-up motion in accordance with the axial shortening of the hollow section 2 that results from expansion of the hollow section 2. Sealing can also be accomplished by means of a suitable radial seal instead of the sealing taper 20. Moreover, it is also conceivable, by additionally applying an axial force to the hollow section 2 by means of the sealing ram 19, to push additional material of the hollow section into the region of the bulge in the hollow section 2, i.e. the branch 8 of the forming die 3, from the ends of the hollow section 2, enabling process reliability in the formation of the neck 10 to be further increased. It is not absolutely essential for the method according to the invention described below for forming the hollow section 2 that the die components 11, 12, 13 and 18 should all be capable of being moved. Depending on requirements, it is also possible for them to be arranged in a rigid manner or for just one or two die components to be capable of movement.

It is also conceivable for all the die components 11, 12 and 13 to vibrate during forming but for die component 11, which is guided along die components 12 and 13 and oscillates radially relative to the hollow section 2, to be excited with a higher amplitude. This has the advantage that the relief of friction has a particularly pronounced effect on the follow-up zone situated at the end of the hollow section, considerably facilitating the supply of extra material at that point and thus allowing the regions in which the degree of forming is higher, such as the region of the neck 10, to be formed with a particularly high degree of process reliability thanks to the increased supply of material. The relief of friction in the remaining region of the cavity 6 is assured by die components 12 and 13, which likewise vibrate.

Once the hollow section 2 has been placed in the forming die 3, the die is closed, after which the sealing rams 19 are moved into their sealing position of use. The counter ram 9 is in its initial position with its end 21 flush with the cavity 6 of the top die 4. Pressurized fluid is then introduced into the hollow section 2 via a feed hole within the sealing ram 19, after which the pressurized fluid is raised to high pressure by means of a high-pressure generation system with a fluid connection to the feed hole. The development of the internal high pressure causes the hollow section 2 to expand, its walls coming to rest against the cavity 6 both of the top die 4 and of the bottom die 5.

In the region of the branch 8, the counter ram 9 is gradually moved backwards and the internal high pressure forces the material of the hollow section as a bubble into the expansion chamber left by the retraction of the counter ram 9. The further the counter ram 9 is moved backwards, the longer this bubble becomes, and it comes to rest against the wall of the branch 8, forming the neck 10.

When the hollow section 2 comes to rest against the cavity 6 and, in the neck 10, against the wall of the branch 8, the hollow section 2 forms a friction partner with the forming die 3 for the rest of the forming operation since, to continue the forming process, i.e. to continue flowing towards the forming location, the material of the hollow section must overcome static friction against the forming die, against which it is pressed by the internal high pressure. Since this frictional resistance is not conducive to a reliable forming process owing to the thinning of the material that takes place in the hollow section 2, it is the intention of the invention to reduce friction and hence increase process reliability during forming. At the same time, it is also possible without detriment to extend the boundaries of the internal high-pressure forming process.

To this end, the apparatus 1 includes at least one generator of structural vibration, which imparts vibration in such a way to at least one friction partner during the forming operation that there is relative radial motion between the friction partners, such that they lose contact between the maxima 22 of the structural vibration (FIGS. 3 and 4). Depending on requirements, there are various ways of achieving this in the apparatus 1. Thus, for example, the die components 11, 12, 13 and 18 can be moved mechanically by means of a reciprocating piston as a vibration generator, which can be moved backwards and forwards by means of an eccentric drive, the components oscillating jointly or independently at a vibration frequency within the hertz or kilohertz range, preferably however in a range of $0<v\leqq 200$ Hz. Here, the structural vibration is introduced in the form of a longitudinal wave directed towards the hollow section 2. The vibration generator can also be a piezo element or a cyclically operated electromagnet. The vibration generator can be integrated into the forming die 3 to save space. It is also conceivable to excite the die components 11, 12, 13 and 18 acoustically. The counter ram 9 can furthermore also be provided with a vibration generator of this kind, in which case the contact pressure of the cap 24 of the neck 10 on the end 21 of the counter ram 9 is reduced by the vibration. If the apparatus 1 additionally includes piercing punches for punching holes in the periphery of the hollow section 2 or forming punches, e.g. when forming blanks, these can also be coupled to a vibration generator. Depending on the progress of the process, the vibration can take place with damping by means of a spring/damper system 25 supported in the bottom die 5, on the one hand against the bottom 26 of the accommodation space 17 of the latter and on the other hand against that side 27 of die component 18 that faces the bottom 26. In the top die 4, this system 25 is supported against the top wall 28 of the accommodation space 14, on the one hand, and against the facing sides 29, 30 of die components 12 and 13, on the other hand. The clamping force on the die components 11, 12, 13 and 18 swings back into its respective normal position during the forming process. It is conceivable here for the clamping force to increase up to the end of the process (FIG. 3) or to remain constant during the entire process (FIG. 4). The vibration can be in the form of purely sinusoidal vibration 23 with shallow amplitudes (FIG. 3) or in the form of a sawtooth 31 (FIG. 4) or a sequence of square-wave pulses. The sawtooth shape and the square-wave pulses are advantageous for the method in that it is possible periodically to achieve a complete spontaneous breaking of the contact between the two friction partners owing to the very steep flanks of the vibration characteristics, thereby reducing total friction very greatly. It is moreover also conceivable for the entire top die 4 and/or the entire bottom die 5 to be excited into vibration.

Another possibility of applying vibration to the friction partners is to excite the hollow section 2 itself. This can be achieved by means of the sealing ram 19, which is coupled to the vibration generator, on the one hand, and, in the sealing position of use, to the workpiece, that is to say to the hollow section 2. In FIG. 1, a reciprocating piston 32 with an eccentric drive 33 is used as the vibration generator, the reciprocating piston 32 being coupled to the sealing ram 19 in a vibrationally effective manner in the radial direction. Excitation causes a transverse wave to propagate in the hollow section 2, following its shape, thereby likewise giving rise to radially oscillating motion of the hollow section 2 relative to the surrounding die 3. With this possibility, it would also be conceivable to combine the introduction of transverse waves into the hollow section 2 and longitudinal waves into a die component 12, 13 and 18 to lift the hollow section 2 in a particularly powerful way from the forming die 3 in contact with it.

The vibration can also be excited in a rotary manner by introducing a torsional vibration if—as shown in FIG. 2—the friction partners, the hollow section 2 and a die component 34 of the forming die 3, said component containing the cavity 6 and comprising two half-shells, are of rotationally symmetrical design. The half-shells are held displaceably in short circumferential slots in the top die 4 and bottom die 5. While die component 34 can be driven rapidly backwards and forwards in a direct manner by a few degrees in the circumferential direction or even by only a fraction thereof, the torsional vibration must be imparted via the sealing ram 19 if it is introduced into the hollow section 2, the ram being driven in accordance with the directions indicated by the arrow by a rotary positioning motor that forms the vibration generator. Excitation of die component 34 by means of torsional vibration promotes the feeding in of additional hollow-section material from the end region of the hollow section 2 in a manner that is simple in terms of the tooling involved, since the end region of the remainder of the hollow section 2 is closest to the point of excitation and is thus most affected. The traversing and bearing forces required here are not high since the die-component mass to be actuated is relatively small. Die component 34 can also be designed as a closed sleeve that is inserted into corresponding recesses in the bottom die 5 before forming and through which the as yet unformed, rectilinear hollow section 2 is subsequently passed. The top die 4 is then lowered onto the bottom die 5 and the forming die 3 is closed to allow forming to proceed. It is furthermore also possible to start excitation of vibration even before the hollow section 2 comes to rest on the cavity 6 since adhesion of the hollow section 2 to the cavity is then lessened or even prevented from the outset.

Finally, it may also be stated that vibrational excitation of the friction partners can also be accomplished by a combination of translatory and rotary excitations.

What is claimed is:

1. Method for internal high-pressure forming of a workpiece in a closed internal high-pressure forming die, the workpiece being expanded owing to the internal high fluid pressure exerted by a pressure generator and coming to rest on the cavity of the forming die, the workpiece and the forming die forming friction partners in the areas of contact, wherein vibration is imparted directly to at least one of the friction partners by a vibration generator during forming.

2. Method according to claim 1, wherein the vibration is introduced into the workpiece in the form of a transverse wave that propagates along the workpiece, following a shape of the workpiece.

3. Method according to claim 1, wherein the vibration is excited mechanically.

4. Method according to claim 1, wherein the vibration is excited by way of a piezo element.

5. Method according to claim 1, wherein the vibration is excited acoustically.

6. Method according to claim 1, wherein the vibration is excited electromagnetically.

7. Method according to claim 1, wherein the vibration is introduced into at least one forming die component in the form of a longitudinal wave directed towards the workpiece.

8. Method according to claim 1, wherein the vibration has a frequency in the hertz to kilohertz range.

9. Method according to claim 8, wherein the vibration frequency is in a range from greater than 0 to 200 Hz.

10. Method according to claim 1, wherein the vibration is by introduction of a torsional vibration, the friction partners being of rotationally symmetrical design.

11. Apparatus for internal high-pressure forming of a workpiece with an internal high-pressure forming die that is split in a direction of extension of the workpiece and is connected to a fluid-pressure generator, the forming die and the workpiece forming friction partners when the workpiece is expanded, and with at least one sealing ram, by way of which the workpiece can be sealed axially, wherein the apparatus includes at least one vibration generator, which is coupled in a vibrationally effective manner to at least one of the friction partners.

12. Apparatus according to claim 11, wherein the vibration generator is a piezo element.

13. Apparatus according to claim 11, wherein the vibration generator is an electromagnet.

14. Apparatus according to claim 11, wherein the vibration generator is a reciprocating piston that can be moved backwards and forwards by way of an eccentric drive.

15. Apparatus according to claim 11, wherein where the vibration is excited in at least one die component, the vibration generator is integrated into the forming die.

16. Apparatus according to claim 11, wherein the vibration generator is a rotary positioning motor that is in operative contact with a friction partner of rotationally symmetrical design.

17. Apparatus according to claim 11, wherein the vibration generator is coupled to the workpiece by way of the sealing ram.

18. A method of making a workpiece, comprising:

placing a hollow workpiece blank in a high pressure forming die, applying high pressure fluid to inside the hollow blank to plastically deform the hollow blank to rest against internal surfaces of the forming die with the workpiece blank and the forming die forming friction partners in respective areas of contact with one another, and imparting vibration forces to at least one of the friction partners during deforming of the hollow blank by the high pressure fluid.

19. A method according to claim 18, wherein the hollow blank is a cylindrical tube and the forming die includes internal surfaces for forming a pipe with a branch stub.

20. A method according to claim 18, wherein the forming die includes a plurality of relatively movable die parts.

21. A method according to claim 20, wherein said imparting vibration includes imparting vibration to at least one of the die parts.

22. A method according to claim 18, wherein said imparting vibration includes imparting vibrations to said hollow blank.

* * * * *